US009868557B2

(12) United States Patent
Kim et al.

(10) Patent No.: US 9,868,557 B2
(45) Date of Patent: Jan. 16, 2018

(54) CABLE PACKAGING FOR MEDICAL DEVICES

(71) Applicant: SAMSUNG MEDISON CO., LTD., Gangwon-Do (KR)

(72) Inventors: Ui Kim, Namyangju-si (KR); Jun Pil Moon, Seoul (KR)

(73) Assignee: SAMSUNG MEDISON CO., LTD., Gangwon-Do (KR)

( * ) Notice: Subject to any disclaimer, the term of this patent is extended or adjusted under 35 U.S.C. 154(b) by 500 days.

(21) Appl. No.: 14/312,111

(22) Filed: Jun. 23, 2014

(65) Prior Publication Data

US 2014/0374308 A1 Dec. 25, 2014

(30) Foreign Application Priority Data

Jun. 24, 2013 (KR) ..... 10-2013-0072207

(51) Int. Cl.

| | |
|---|---|
| ***B65B 53/00*** | (2006.01) |
| ***B65D 71/08*** | (2006.01) |
| ***B65B 53/02*** | (2006.01) |
| ***B65D 75/02*** | (2006.01) |

(52) U.S. Cl.

CPC ..... *B65B 53/02* (2013.01); *B65D 75/02* (2013.01)

(58) Field of Classification Search

CPC ..... B65D 75/02; B65D 75/002; B65D 71/08; B65D 71/10; B65D 2571/00024; B65B 53/00; B65B 53/02; B32B 27/08

USPC ..... 206/438, 484, 484.2, 497; 229/87.5; 138/110; 428/34.9, 35.1

See application file for complete search history.

(56) References Cited

U.S. PATENT DOCUMENTS

| | | | | | |
|---|---|---|---|---|---|
| 3,260,358 | A * | 7/1966 | Gottily | B65D 75/002 | 206/410 |
| 3,528,825 | A * | 9/1970 | Doughty | A22C 13/023 | 134/22.11 |
| 4,018,337 | A * | 4/1977 | Barnett | B32B 27/08 | 206/386 |
| 4,166,532 | A * | 9/1979 | Tsuchida | B65D 71/10 | 206/497 |
| 5,302,428 | A * | 4/1994 | Steele | B29C 61/0616 | 138/128 |
| 5,535,787 | A * | 7/1996 | Howell | H02G 3/0487 | 138/110 |
| 5,901,756 | A * | 5/1999 | Goodrich | F16L 3/233 | 138/110 |

(Continued)

*Primary Examiner* — Luan K Bui

(74) *Attorney, Agent, or Firm* — McDermott Will & Emery LLLP

(57) ABSTRACT

Disclosed herein is a cable packaging for medical devices that is provided with a perforated line and having heat shrinkage characteristic. With a capable packaging for medical devices to wrap around a cable that is configured to connect two or more apparatuses to each other, the cable packaging is formed of material that is shrunken by heat so as to come into close contact with the cable, and the cable packaging includes a perforated line so as to be separated from the cable. By forming the packaging using heat shrinkage material, a packaging volume is reduced, and by fixing the packaging so as to come into close contact with the cable, the durability of a connecting portion is improved. By forming a perforated line, the packaging is removed or maintained according to use of a user, and contaminated substance is easily cleaned

7 Claims, 6 Drawing Sheets

(56) References Cited

U.S. PATENT DOCUMENTS

| | | | | |
|---|---|---|---|---|
| 6,001,438 | A * | 12/1999 | Bourgault | B29C 71/04 428/34.9 |
| 6,102,076 | A * | 8/2000 | Romero, Jr. | F01N 13/085 138/110 |
| 6,206,430 | B1 * | 3/2001 | Pond | F16L 37/08 285/3 |
| 6,881,904 | B2 * | 4/2005 | Millas | D06M 11/74 174/1 |
| 8,205,314 | B1 * | 6/2012 | Dermody, IV | B21D 49/00 29/428 |
| 2006/0127620 | A1 * | 6/2006 | Fisher | F16L 11/127 428/36.91 |
| 2009/0018633 | A1 * | 1/2009 | Lindquist | A61F 2/0095 623/1.11 |
| 2011/0171517 | A1 * | 7/2011 | Lee | H01M 2/023 428/34.9 |
| 2013/0315672 | A1 * | 11/2013 | Pajak | F16L 1/028 138/110 |

* cited by examiner

CABLE PACKAGING FOR MEDICAL DEVICES

CROSS-REFERENCE TO RELATED APPLICATION

This application claims the benefit of the Korean Patent Application No. 2013-0072207, filed on Jun. 24, 2013, in the Korean Intellectual Property Office, the disclosure of which is incorporated herein by reference.

BACKGROUND

1. Field

Embodiments of the present disclosure relate to a cable packaging for medical devices, and more particularly, to a cable packaging for medical devices that is provided with a perforated line and formed using contractive material by heat.

2. Description of the Related Art

A cable refers to a bundle of conductive material being used to connect two or more apparatuses to each other. In general, the cable is composed of a conductor configured to deliver electrical signals and a protective cover, which is formed of insulating material, configured to wrap around the conductor.

A packaging is used to prevent a contamination of an exterior surface of the cable. The reason for using the packaging is to protect the exterior surface of the cable from contamination or damage while a delivery is being made. However, a user uses the packaging without removing the packaging from the cable even after the cable is installed at the place of an installation due to the concern over the exterior surface of the cable being contaminated.

Particularly, in the case of a medical device, the cleanliness is highly vital with respect to the environment in which the medical device is being used. In a case when the packaging of the cable for the medical device is contaminated or in a case when the cable is contaminated as the packaging is removed, a patient may feel certain level of displeasure as a result.

The conventional packaging formed of vinyl substance may be difficult to clean in a case when the packaging is contaminated. In addition, since the volume of the packaging is large, a tangling of the cables or a physical interference may be occurred. In addition, the packaging is moved according to the movement of the cable without being fixed to the cable, therefore a difficulty is present in the usage of the cable. Furthermore, a user may be needed to be provided with additional material to adjust the packaging range of packaging to fit the environment in which the cable is to be used.

SUMMARY

Therefore, it is an aspect of the present disclosure to provide a cable packaging for medical devices that is formed using heat shrinkable material.

It is another aspect of the present disclosure to provide a cable packaging for medical devices that is capable of adjusting the packaging range according to use of a user by forming a perforated line.

Additional aspects of the disclosure will be set forth in part in the description which follows and, in part, will be obvious from the description, or may be learned by practice of the disclosure.

In accordance with an aspect of the present disclosure, a cable packaging for medical devices to wrap around a cable that is configured to connect two or more apparatuses to each other is provided. The cable packaging may be formed of material that is shrunken by heat so as to come into close contact with the cable. The cable packaging may include a perforated line so as to be separated from the cable.

The perforated line may be formed in a way that a range of packaging the cable is adjusted according to use.

The cable packaging may further include a metallic film provided at an inside thereof to shield electromagnetic wave.

The cable may be wrapped in multiple layers.

Even in a case when one layer of the cable packaging is removed, another layer of the cable packaging may be positioned to maintain the wrapping of the cable.

The cable packaging may further include a grip that may be provided at one side of the perforated line so that the packaging is removed along the perforated line.

The cable packaging may wrap around the cable and a connecting portion, at which the cable is connected to the apparatus.

The perforated line may be formed in a way that a range of packaging the connecting portion is adjusted according to use.

The cable packaging may be provided in various colors such that the cable is distinguished according to use.

The material shrunken by heat may represent a heat shrink tube or a shrink film.

As apparent from the above, by forming the packaging using the heat shrinkage material, packaging volume may be reduced, and by fixing the packaging so as to come into close contact with the cable, the durability of a connecting portion may be improved.

In addition, by forming a perforated line, the packaging may be removed or maintained according to use of a user, and contaminated substance may be easily cleaned.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
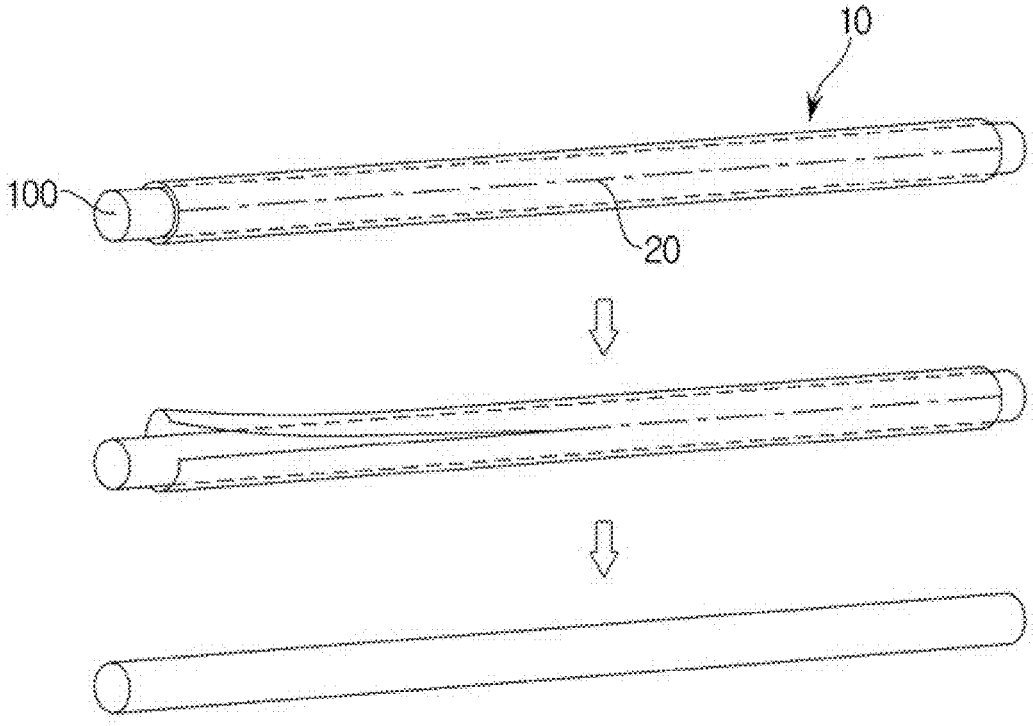
FIG. 1 is a drawing illustrating a cable packaging for medical devices in accordance with one embodiment of the present disclosure.

Reference will now be made in detail to the embodiments of the present disclosure, examples of which are illustrated in the accompanying drawings, wherein like reference numerals refer to like elements throughout.

A cable is referred to as a type of a cable being used to connect more than two apparatuses to each other, and is provided with a circular cross section in general. The cable is elongated to connect the apparatuses to each other, and the cable may be provided with a proper length for use. On the drawing, for the sake of convenience, the cable having a predetermined length is described, and a packaging having a proper length to wrap around the cable is illustrated.

FIG. 1 is a drawing illustrating a cable packaging 10 for medical devices in accordance with one embodiment of the present disclosure.

The packaging 10 wrapping around a cable 100 is provided. At the packaging 10, a perforated line 20 is provided in longitudinal direction of the cable 100. A user may be able to remove the packaging 10 from the cable 100 by tearing off the packaging 10 along the perforated line 20.

The packaging 10 may be formed of material having shrinkage characteristic when heat is applied. The packaging 10 may be a heat shrink tube having a cylindrical shape and provided with shrinkage characteristic by heat, or a shrink film that is being used as a PET label. The packaging 10 having a larger cross section when compared to that of the cable 100 is inserted around the cable 100, and heat is applied to make the packaging 10 closely contact with the cable 100. As the packaging 10 comes into close contact with the cable 100, the cable 100 may be packaged without having a volume difference compared to the original volume of the cable 100.

The packaging 10 may be provided in various colors. At a medical device, a plurality of cables 100 may be installed, and the plurality of cables 100 each may be different in terms of usage. By differing the color of the packaging 10 according to use of the cable 100, the cable 100 may be distinguished.

At an inside the packaging 10, a metallic film may be included to shield electromagnetic wave. The cable 100 is a type of a cable configured to connect electronic apparatus such as a medical device, and may be able to release electromagnetic wave to an outside. The cable 100 includes material that is capable of shielding electromagnetic wave, but is difficult to shielding electromagnetic wave completely. Through the packaging 10 surrounding the outside of the cable 100, the releasing of electromagnetic wave to an outside may be prevented at further enhanced efficiency.

Figure 2:
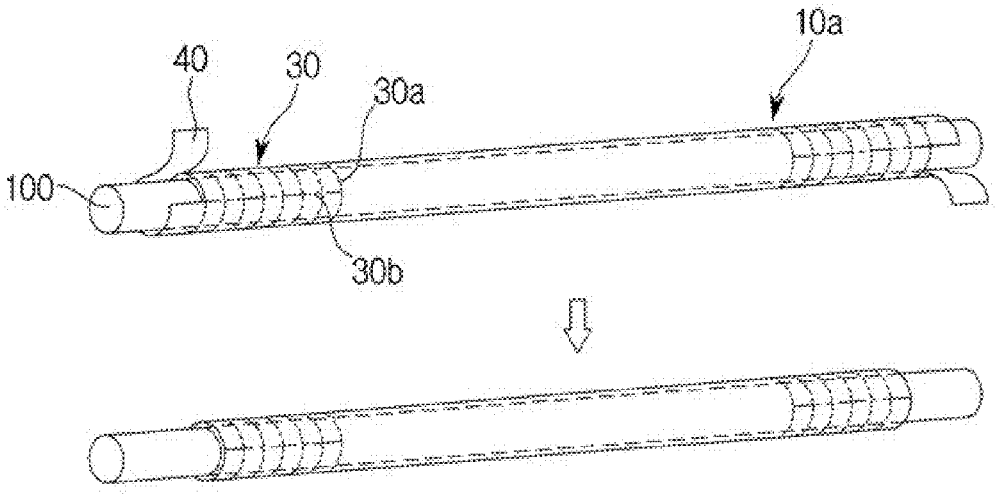
FIG. 2 is a drawing illustrating the variability of the packaging range of a cable packaging for medical devices in accordance with one embodiment of the present disclosure.

FIG. 2 is a drawing illustrating the variability of the packaging range of a cable packaging 10*a* for medical devices in accordance with one embodiment of the present disclosure.

The packaging 10*a* wrapping around the cable 100 may be provided with a perforated line 30 only at both sides of the packaging 10*a* other than a central portion thereof. The perforated line 30 may include a first perforated line 30*a* provided in a longitudinal direction to the cable 100 and a second perforated line 30*b* provided in a direction perpendicular to the first perforate line 30*a*.

The first perforated line 30*a* may be provided at the both sides of the packaging 10*a* other than the central portion of the packaging 10*a* so as to extend in a longitudinal direction of the cable 100. The second perforated line 30*b* may be provided in plurality, up to a portion at which the first perforated line 30*a* is provided. In a packaged state, the second perforated line 30*b* may be provided in a circular shape according to the cross section of the cable 100.

A packaging piece 40, which is a portion of the packaging 10*a*, may be torn off along the second perforated line 30*b* after the packaging 10*a* is torn off along the first perforated line 30*a*. As the packaging piece 40 is removed, a portion of the cable 100 may be exposed. The cable 100 may be exposed as much as desired by removing the packaging piece 40 along the perforated line 30.

Figure 3:
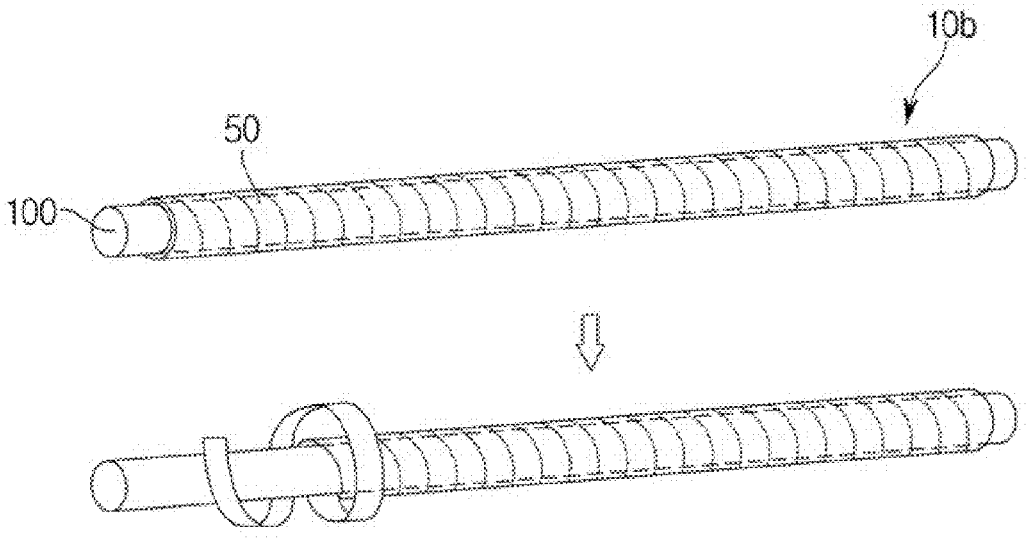
FIG. 3 is a drawing illustrating the variability of the packaging range of a cable packaging for medical devices in accordance with another embodiment of the present disclosure.

FIG. 3 is a drawing illustrating the variability of the packaging range of a cable packaging 10*b* for medical devices in accordance with another embodiment of the present disclosure.

The packaging 10*b* wrapping around the cable 100 may include a perforated line 50 provided in the shape of a spiral. The perforated line 50 may be provided to extend in the shape of a spiral with respect to the longitudinal direction of the cable 100. As the perforated line 50 is provided to extend from one side of the packaging 10*b* to the other side in the shape of a spiral, the packaging 10*b* may be easily removed along the perforated line 50.

From one side of the packaging 10B, the packaging 10*b* may be removed by rotating toward a cross-sectional direction of the cable 100 along the perforated line 50. By removing the packaging 10*b* as much as desired, a portion of the cable 100 being exposed may be adjusted.

Figure 4:
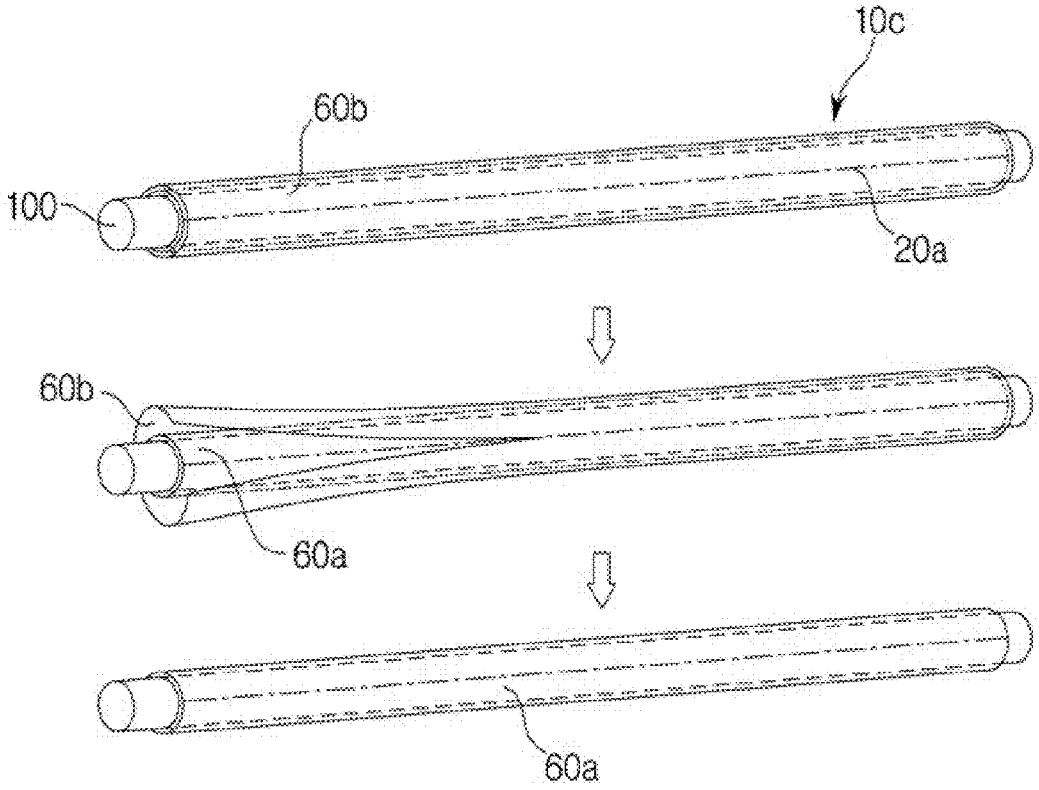
FIG. 4 is a drawing illustrating a cable packaging for medical devices in accordance with one embodiment of the present disclosure being packaged in several layers.

FIG. 4 is a drawing illustrating a cable packaging 10*c* for medical devices in accordance with one embodiment of the present disclosure being packaged in several layers.

The packaging 10*c* wrapping around the cable 100 may be provided in several layers. On FIG. 4, the packaging 10*c* having two layers is illustrated, and the packaging 10*c* may include a first packaging 60*a* positioned at an inner side and a second packaging 60*b* positioned at an outer side. At each of the first packaging 60*a* and the second packaging 60*b*, a perforated line 20*a* provided in a longitudinal direction of the cable 100 may be included.

In a case when the second packaging 60*b* positioned at an outer side is contaminated by contaminated substance, the second packaging 60*b* may be torn off along the perforated line 20*a* and then removed. Even when the second packaging 60*b* is removed, the first packaging 60*a* is remained at the cable 100 to prevent the contamination of the cable 100. The packaging 10*c* includes material that is shrunken by heat and comes into close contact with the cable 100, and thus the change of an overall volume is small even when the cable 100 is wrapped around in several layers of the packaging 10*c*. Thus, the cable 100 is wrapped around by use of the plurality of packaging 10*c*, and may be used by removing the plurality of packaging 10*c* one layer at a time.

Figure 5:
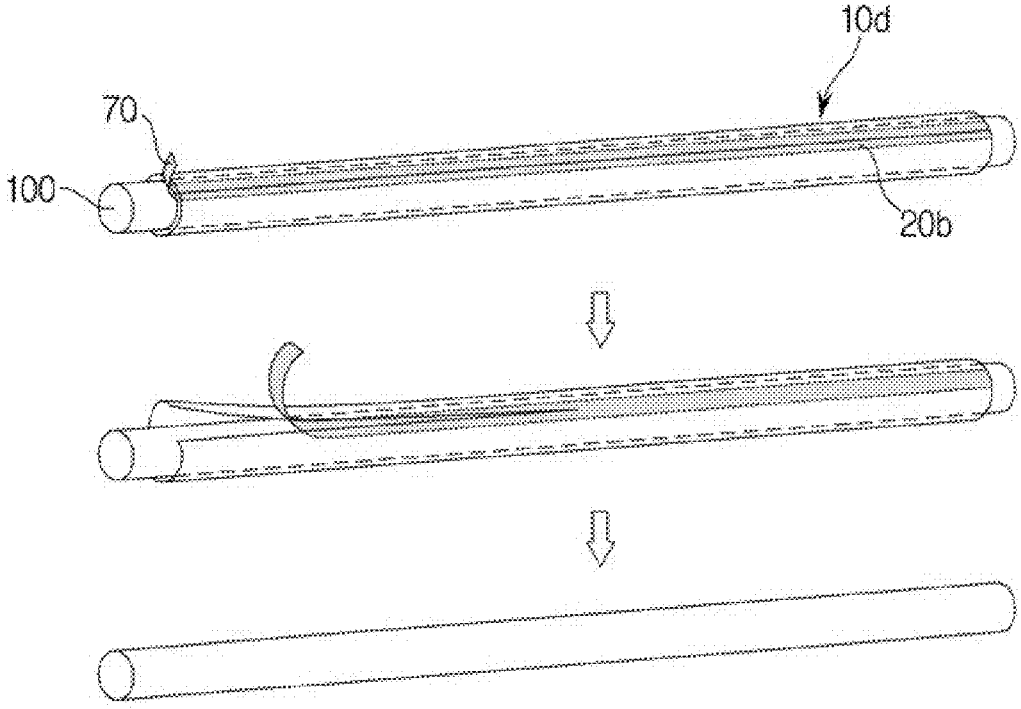
FIG. 5 is a drawing illustrating a grip included in a cable packaging for medical devices in accordance with one embodiment of the present disclosure.

FIG. 5 is a drawing illustrating a state of a grip included in a cable packaging 10*d* for medical devices in accordance with one embodiment of the present disclosure.

At the packaging 10*d* wrapping around the cable 100, a perforated line 20*b* may be provided in a longitudinal direction of the cable 100. The packaging 10*d* is referred to as shrinkage material by heat and comes into close contact with the cable 100, and thus difficulty may be present in removing the packaging 10*d*. Thus, a grip 70 may be provided at one side of the packaging 10*d* so as to remove the packaging 10*d* easily along the perforated line 20*b*.

The grip 70 may be provided lengthways along the perforated line 20*b* at a lower portion of the perforated line 20*b*. The packaging 10*d* may be torn off along the perforated line 20*b* by pulling the grip 70 that is stuck out at the one side of the packaging 10*d*. As the packaging 10*d* is torn off, the packaging 10*d* may be easily removed from the cable 100.

Figure 6:
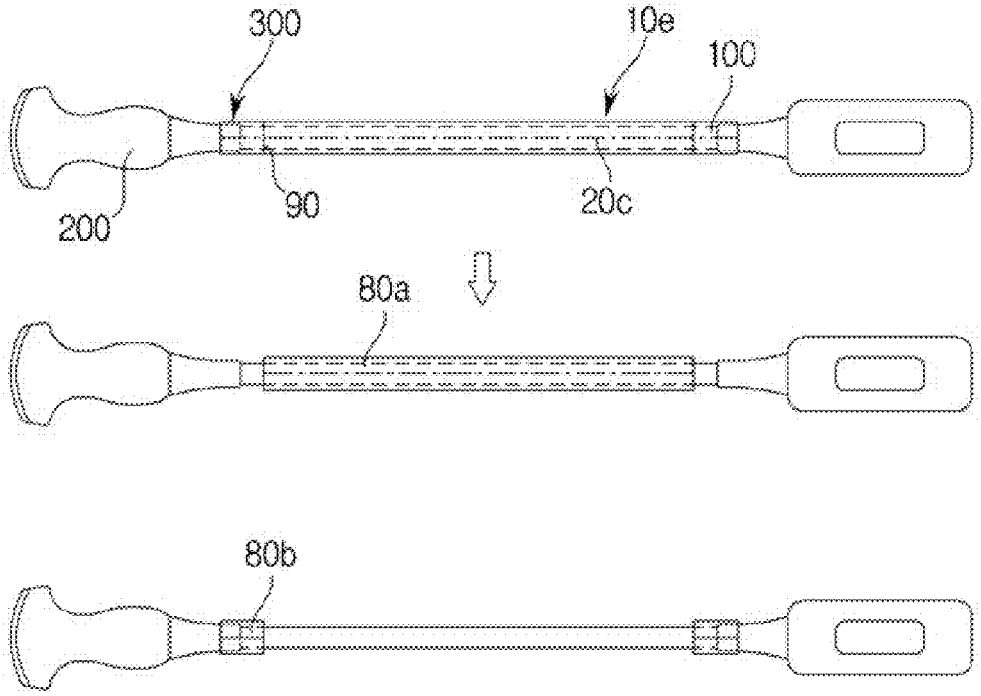
FIG. 6 is a drawing illustrating the cable packaging for medical devices in accordance with one embodiment of the present disclosure being packaged up to a connecting portion.

FIG. 6 is a drawing illustrating a cable packaging 10*e* for medical devices in accordance with one embodiment of the present disclosure being packaged up to a connecting portion 300.

The cable 100 is provided in a way to connect two or more apparatuses 200. The connecting portion 300 at which the apparatus 200 is connected to the cable 100 is provided. In general, a medical device may be provided in a way that an apparatus at one side of the medical device is moved to proceed with a test while an apparatus at the other side is fixedly installed to observe the result of the test. At this time, as the apparatus at the one side is moved, the connecting portion 300 connected to the cable 100 may be damaged while receiving continuous stress.

The packaging 10*e* may be provided to wrap around the cable 100 as well as the connecting portion 300 at which the apparatus 20 is connected to the cable 100. As the packaging 10*e* wraps around the connecting portion 300, the damage of the connecting portion 300 may be prevented.

At the packaging 10*e*, a perforated line 20*c* provided in a longitudinal direction of the cable 100 and a separating line 90 configured to divide the packaging 10*e* into a first portion 80*a* and a second portion 80*b* are provided. The first portion 80*a* is provided in a way to wrap around the cable 100, and the second portion 80*b* may be provided in two units thereof to wrap around the connecting portions 300 provided at both sides of the cable 100.

By using the separating line 90, the first portion 80*a* or the second portion 80*b* is removed, and thus only a desired portion may be exposed. By removing the first portion 80*a*, the durability and the waterproofing ability of the connecting portion 300 may be improved in the shape of the second portion 80*b* packaged at the connecting portion 300. On the contrary, by removing the second portion 80*b*, the first portion 80*a* may be remained to prevent the contamination of the cable 100.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cable packaging wrapped around a cable, the cable configured to connect two or more medical devices, wherein:

the cable packaging is formed of material that is shrunken by heat, and wherein the cable is wrapped in multiple layers of the cable packaging, each layer of the multiple layers including a perforated line, and each perforated line being aligned with the perforated line of the other layers, and wherein even in a case when one layer of the cable packaging is removed, another layer of the cable packaging is positioned to maintain the wrapping of the cable.

2. The cable packaging for medical devices of claim 1, further comprising:

a metallic film provided at an inside thereof to shield electromagnetic wave.

3. The cable packaging for medical devices of claim 1, further comprising:

a grip provided at one side of the perforated line so that the cable packaging is removed along the perforated line.

4. The cable packaging for medical devices of claim 1, wherein the cable packaging wraps around the cable and a connecting portion, at which the cable is connected to the apparatus.

5. The cable packaging for medical devices of claim 4, wherein the perforated line is formed in a way that a range of packaging the connecting portion is adjustable.

6. The cable packaging for medical devices of claim 1, wherein the cable packaging is provided in various colors such that the cable packing is distinguishable.

7. The cable packaging for medical devices of claim 1, wherein the material shrunken by heat represents a heat shrink tube or a shrink film.

* * * * *